US010924853B1

(12) United States Patent
Curtis et al.

(10) Patent No.: US 10,924,853 B1
(45) Date of Patent: Feb. 16, 2021

(54) SPEAKER NORMALIZATION SYSTEM

(71) Applicant: ROKU, INC., Los Gatos, CA (US)

(72) Inventors: Robert Curtis, Los Gatos, CA (US); Kasper Andersen, Aarhus N (DK); Andrey Eltsov, Pleasanton, CA (US); Mark Janossy, Cambridge (GB)

(73) Assignee: ROKU, INC., Los Gatos, CA (US)

( * ) Notice: Subject to any disclaimer, the term of this patent is extended or adjusted under 35 U.S.C. 154(b) by 0 days.

(21) Appl. No.: 16/702,853

(22) Filed: Dec. 4, 2019

(51) Int. Cl.
*H04R 3/12* (2006.01)
*H04R 1/26* (2006.01)
*H04R 29/00* (2006.01)

(52) U.S. Cl.
CPC ..... *H04R 3/12* (2013.01); *H04R 1/26* (2013.01); *H04R 29/002* (2013.01)

(58) Field of Classification Search
CPC . H04R 3/12; H04R 29/00; H04R 1/26; H04R 2205/024; H04R 2420/07; H04S 7/301
USPC ..... 381/59
See application file for complete search history.

(56) References Cited

U.S. PATENT DOCUMENTS

2008/0077261 A1* 3/2008 Baudino ..... H04H 20/63 700/94
2008/0207123 A1* 8/2008 Andersen ..... H04S 1/00 455/41.1
2015/0208188 A1* 7/2015 Carlsson ..... H04S 7/301 381/79
2017/0188151 A1* 6/2017 Veeramani ..... H04S 7/301

* cited by examiner

*Primary Examiner* — Melur Ramakrishnaiah
(74) *Attorney, Agent, or Firm* — Sterne, Kessler, Goldstein & Fox P.L.L.C.

(57) ABSTRACT

System, method, and various embodiments for providing a speaker normalization system are described herein. An embodiment operates by identifying a plurality of audio output devices connected to an audio source. For each audio output device, a set of technical capabilities and a relative position of the audio output device is identified. An audio configuration is calculated based on both the set of technical capabilities and the relative position of each audio output device, and which audio output devices are identified. The calculated audio configuration is provided to each identified audio output device. Audio is provided to each of the identified audio output devices.

20 Claims, 3 Drawing Sheets

SPEAKER NORMALIZATION SYSTEM

TECHNICAL FIELD

This disclosure generally relates to normalizing speakers of an audio system based on the capabilities of the speakers.

BACKGROUND

The audio portion of a television program or movie (or other content) that a person is watching at home can greatly impact the overall user experience. While poor sounding audio can detract from the user experience, an improved configuration of the audio equipment can enhance a user's experience. However, as a person adds/removes speakers and/or rearranges the audio equipment, it can become burdensome for a user to determine how to adjust the audio configuration settings each time a change is made to maintain or improve the sound.

SUMMARY

Various embodiments are described throughout this specification. This disclosure is not limited to the summary provided herein.

An example embodiment may include a method. In an embodiment, for each audio output device, a set of technical capabilities and a relative position of the audio output device are identified. An audio configuration is calculated based on both the set of technical capabilities and the relative position of each audio output device, and which audio output devices are identified. The calculated audio configuration is provided to each identified audio output device. Audio is provided to each of the identified audio output devices.

Another embodiment may include a system. The system includes a memory and one or more processors coupled to the memory. The one or more processors are configured to perform various operations. In an embodiment, for each audio output device, a set of technical capabilities and a relative position of the audio output device are identified. An audio configuration is calculated based on both the set of technical capabilities and the relative position of each audio output device, and which audio output devices are identified. The calculated audio configuration is provided to each identified audio output device. Audio is provided to each of the identified audio output devices.

Another embodiment may include a non-transitory computer-readable device having instructions stored thereon. In an embodiment, for each audio output device, a set of technical capabilities and a relative position of the audio output device are identified. An audio configuration is calculated based on both the set of technical capabilities and the relative position of each audio output device, and which audio output devices are identified. The calculated audio configuration is provided to each identified audio output device. Audio is provided to each of the identified audio output devices.

BRIEF DESCRIPTION OF THE DRAWINGS

The accompanying drawings are incorporated herein and form a part of the specification.

In the drawings, like reference numbers generally indicate identical or similar elements. Additionally, generally, the left-most digit(s) of a reference number identifies the drawing in which the reference number first appears.

DETAILED DESCRIPTION

Provided herein are system, apparatus, device, method and/or computer program product embodiments, and/or combinations and sub-combinations thereof, for providing a speaker normalization system.

The audio portion of a television program or movie (or other content) that a person is watching at home can greatly impact the overall user experience. While poor sounding audio can detract from the user experience, an improved configuration of the audio equipment can enhance a user's experience. However, as a person adds/removes speakers and/or rearranges the audio equipment, it can become burdensome for a user to determine how to adjust the audio configuration settings each time a change is made to maintain or improve the sound. The speaker normalization system (SNS) described herein addresses these and other issues related to audio configuration, enhancement, normalization, and optimization.

Figure 1:
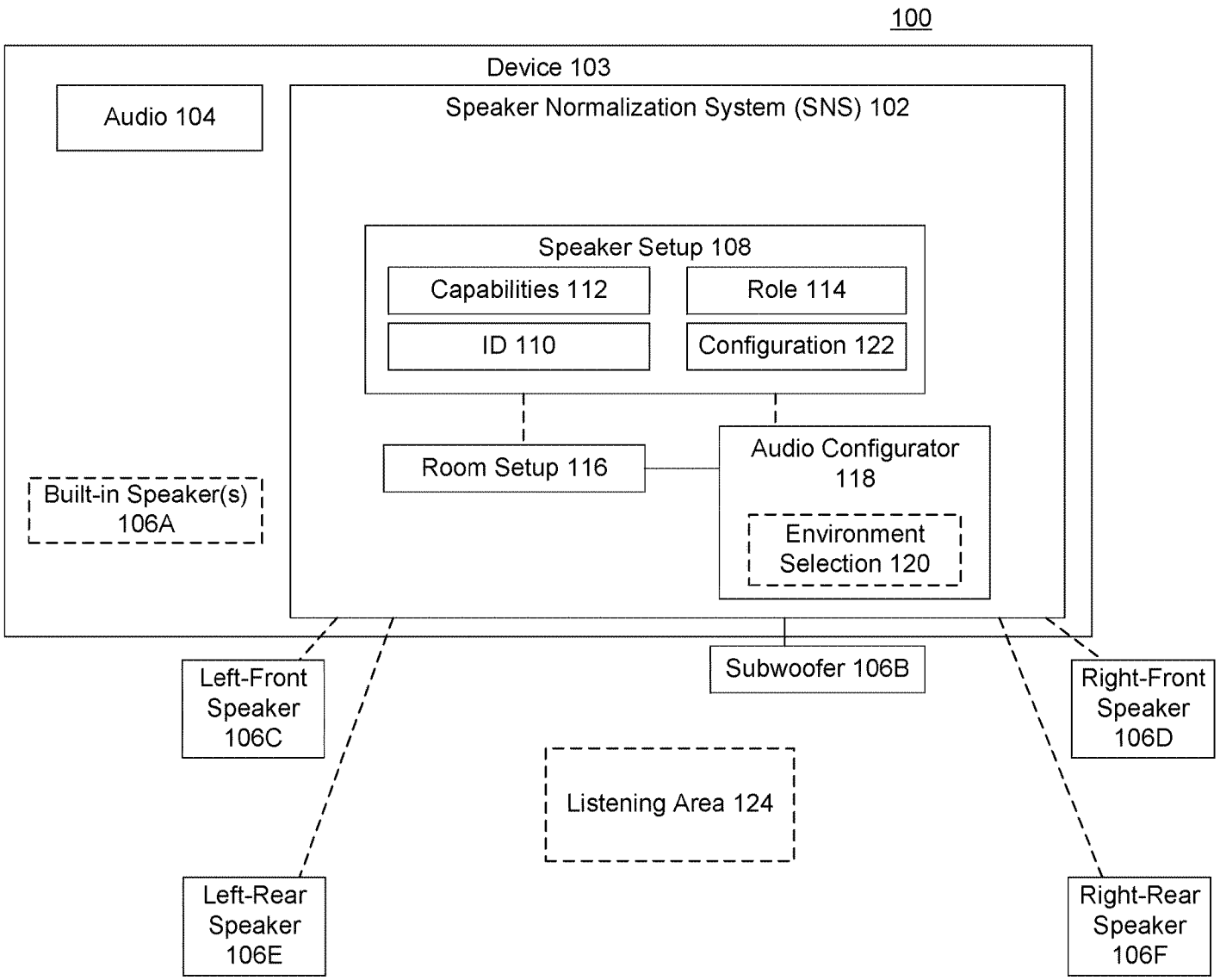
FIG. 1 is a block diagram illustrating example functionality for providing a speaker normalization system (SNS), according to some embodiments.

FIG. 1 is a block diagram 100 illustrating example functionality for providing a speaker normalization system (SNS) 102, according to some embodiments. SNS 102 may automatically configure the settings or acoustics various speakers and/or other audio components in a room or listening area 124. SNS 102 may detect when changes are made to the equipment (being added, removed, or relocated) and automatically adjust the audio settings to improve or optimize the sound being output by the system as a whole.

In an embodiment, SNS 102 may be an audio configuration, normalization, or enhancement system that is built into a device 103. Device 103 may be any device configured to receive and/or distribute audio data to various speakers 106. In different embodiments, device 103 may be a sound bar, an audio receiver (e.g., that may be configured to receive audio from one or more other sources, including a tuner), or a streaming media player for audio, video, or other multimedia. SNS 102 may either be built into or integrated into another device 103, such as a sound bar (as illustrated), or may be a standalone device that is communicatively coupled (wired or wirelessly) to a sound bar, receiver, or streaming media player.

Device 103 may receive audio 104 that is to be output through one or more speakers 106. Audio 104 may include music, audio of a movie or television show, audio of a streaming or online video program, or audio received from one or more connected devices such as microphones, DVD players, gaming consoles, mobile phones, streaming audio, over Bluetooth, WIFI, or other wired or wireless connections. In an embodiment, audio 104 may be received through an antenna, wireless, wired, or Internet connection.

In the example illustrated, device 103 may include built-in speaker(s) 106A. Built-in speaker(s) 106A may include one or more speakers that are built into or previously communicatively coupled to operate with the same device as SNS 102 through either a wired or wirelessly connection to device 103. In an embodiment, SNS 102 may be previously configured by or in collaboration with the manufacturer of device 103 to operate built-in speaker 106A. SNS 102 may include or already have available the capabilities 112 of built-in speaker(s) 106A upon boot up or restart.

However, only using the built-speaker(s) 106A may not provide a user with the desired acoustic environment they want when watching television or listening to music (e.g., audio 104). A user may want more speakers and/or speakers with varying capabilities, other than those of built-in speaker(s) 106A. Furthermore, the user may want to arrange those speakers in different locations around a room or physical environment or listening area 124.

As such, the user may connect any of one or more additional speakers 106B-106F to device 103 to operate in conjunction with or in lieu of built-in speaker(s) 106A. The wired or wireless connections to device 103 may enable device 103 to transmit audio 104 and other signals or data to speakers 106B-F. It is understood that the speakers 106 (which is a term used to refer generally to any combination of one or more of the speakers 106A-F) illustrated are merely exemplary, and other embodiments, may include additional, fewer, or different speakers or other audio output devices in various other physical arrangements than those specifically described in the examples provided herein. For example, the manufacturer provided or built-in speaker(s) 106A may not exist, may not be used, or may be disabled or disconnected by a user.

In an embodiment, a user may add or connect a subwoofer 106B to device 103, including built-in speaker(s) 106A. Subwoofer 106B may be a speaker that is designed, configured, or manufactured to produce lower pitched audio frequencies (relative to standard or non-subwoofer speakers) known as bass or sub-bass. For example, in an embodiment, the frequency range for subwoofer may be 20-200 Hz in a consumer product, while the frequency range for another non-subwoofer speaker or may be from 150 Hz-300 Hz.

Thus the subwoofer 106B may be designed to produce or audibly output lower frequencies than a normal, standard, or non-subwoofer speaker. In an embodiment, an audio system may include tweeter speakers which are designed to produce higher frequencies than standard or non-tweeter speakers. As such, the various speakers 106A-F which may be added to an audio system may include differing and/or overlapping capabilities. SNS 102 may receive notification of these varying and overlapping capabilities and may account for or optimize or improve the configuration of the overall system audio output when configuring the audio environment. SNS 102 may also update the configuration as speakers 106A-F are connected, disconnected, added, removed, and/or physically moved or rearranged.

In continuing the example above, built-in speaker(s) 106A with 150 Hz-300 Hz frequency capabilities and a subwoofer 106B with 20-200 Hz capabilities are connected to device 103, SNS 102 may assign lower frequency audio outputs to subwoofer 106B and higher frequency audio outputs to built-in speaker 106A. Device 103 may transmit this configuration 122 information to the speakers 106A, 106B. This division or usage of the varying capabilities of the speakers 106A, 106B may improve the audio experience for a user as well as reduce the amplitude and/or power consumption/usage if the two or speakers 106A, 106B are not simultaneously outputting the same frequency range.

In an embodiment, the user may pair or communicatively connect the device 103 with the newly added speakers, e.g., subwoofer 106B. The pairing process may include establishing Bluetooth or WIFI communications between subwoofer 106B and SNS 102, connecting a wire, and/or providing initialization information via an interface of SNS 102. The result of this pairing process may allow SNS 102 and subwoofer 106B to discover or find each other and exchange data or communicate with each other.

When a new speaker 106B is connected to audio device 103, or is otherwise registered with SNS 102, SNS 102 may reconfigure the acoustic environment or speaker settings or configurations 122 to take into account the newly connected or identified speaker 106B. SNS 102 may also reconfigure the audio or acoustic environment when a speaker is detected to be disconnected or rearranged in a room or listening area 124 (because the relative positions of the speakers 106 may affect how audio in a listening area 124 sounds and how the overall system is configured by SNS 102). As such the configurations 122 of speaker 106B may be at least partially dependent on how speakers 106C-F are configured, and vice versa.

In an embodiment, when a new speaker 106B is detected by SNS 102 to be connected to device 103, SNS 102 may perform an initialization or setup process. During the initialization process, SNS 102 may identify information for a speaker setup 108. In an embodiment, speaker setup 108 may include information about each of the speakers 106 that are connected or communicatively coupled to SNS 102.

The initial setup process for a speaker 106 may include assigning a speaker ID 110. Speaker ID 110 may be a serial number, media access control (MAC) address, Internet protocol (IP) address, speaker name, or other user or system assigned identifier that distinguishes the speaker from other connected speakers. In an embodiment, the speaker ID 110 may indicate a relative position of the speaker within a room or listening area 124 making the speaker 106 easily identifiable or distinguishable by a user.

Capabilities 112 may include the technical capabilities or specifications of a speaker. In an embodiment, capabilities 112 may include a frequency range, amplitude, volume capabilities, power usage/output, time delay information, digital signal processing capabilities, low or high frequency processing capabilities, etc. In an embodiment, SNS 102 may receive a set of capabilities 112 from a newly connected speaker 106. For example, as part of a handshaking or connection process, subwoofer 106B may transmit capability information 112 to SNS 102 which may store it as part of speaker setup 108. In an embodiment, a user may provide capabilities 112 information about various speakers 106.

In an embodiment, after connecting to a new speaker 106, device 103 or SNS 102 may determine or calculate the time delay information. The time delay may indicate a communication or data relay time between device 103 and a particular speaker 106. The time delay may depend on any number of factors including, but not limited to, whether it's a wired or wireless connection, whether the connection is Bluetooth or WIFI, the relative placement or distance between a speaker 106 and device 103, bandwidth capabilities, the size of an audio file or audio packets corresponding to audio 104, etc. This time delay information may be stored as part of the speaker's capabilities 112 or configuration 122.

In an embodiment, time delay may vary based on which speakers 106 are connected to a system. In an embodiment, the time delays for the speakers may be configured such that the same portions or data packets of audio 104 are output by most or all of the connected speakers 106 simultaneously or substantially simultaneously (to avoid the user hearing echoes or experiencing delays from certain speakers 106). In an embodiment, the time delay may cause device 103 or SNS 102 to buffer certain audio packets for identified speakers 106 prior to transmission.

For example, if a new speaker 106F is connected to device 103, and is located 100 feet away from device 103, the time delay for a closer speaker 106D that is located 3 feet from device 103 may be increased to account for the travel time of an audio data packet traveling to the further speaker 106F. As such, the same data packet may be transmit at two different times to speakers 106D and 106F, to account for the travel time or distance to speaker 106F.

Role 114 may indicate a position, location, installation, and/or distance of a speaker 106 within a room, relative to audio device 103, relative to a listening area 124, and/or relative to one or more other connected speakers 106. Example roles 114 for the speakers 106A-F are illustrated in the FIG. 1 and include, but are not limited to, built-in, subwoofer (which may include a positioning of the subwoofer), left-front, left-rear, right-front, and right-rear. In an embodiment, the role for speaker 106B may be subwoofer-center.

In an embodiment, role 114 may include a distance from device 103. For example, left-front speaker 106C may be 3 feet from device 103, and right-front-speaker may be 7 feet from device 103. This variance in distance may also impact or affect the time delay as described above. Or, for example, role 114 may indicate a height (e.g., from the floor) at which a speaker 106 is placed or mounted.

In an embodiment, SNS 102 may include a room setup 116 configuration option as well. Room setup 116 may indicate a size, shape, dimensions, and/or relative speaker arrangement of the various speakers 106 within a room or other listening environment or area 124. In an embodiment, the roles 114 of speakers may vary based on the room setup 116. In an embodiment, room setup 116 may indicate which speakers 106A-F have been connected to SNS 102 and are operable or detected as part of a current audio 104 output. In an embodiment, room setup 116 may indicate how the speakers 106 are positioned relative to each other, device 103, and/or a listening area 124.

In an embodiment, a user may make an environment selection 120. Environment selection 120 may indicate what type of audio or listening environment a user wants to replicate, simulate, or experience with the connected speakers 106. Some example listening environments include: theater, stadium, outdoor, television, and concert. In an embodiment, SNS 102 may configure the speakers 106 differently if a user selects theater instead of stadium as an environment selection 120.

Based on room setup 116, the speaker setup information 108, and any environment selection 120 by a user, an audio configurator 118 may calculate a configuration 122 for each connected speaker 106. In an embodiment, audio configurator 118 may normalize the speakers 106 based on their capabilities and locations or roles 114 to create an improved or optimized listening environment or sound output for a user in a listening area 124.

Listening area 124 may be a projected location of where a user would most likely be sitting or standing in listening to audio 104. Or, for example, listening area 124 may be a calculated central or optimal listening location based on room setup 116.

Audio configurator 118 may take into account the acoustic, diagnostic, or technical capabilities 112 of the various connected speakers 106 and generate a unique audio configuration 122 of those capabilities for each speaker 106, taking into account all the other connected speakers 106. In an embodiment, SNS 102 may transmit, provide, or otherwise make available the configuration 122 information to each connected speaker 106A-F. Then, for example, when receiving audio 104, the speakers 106 may output the audio 104 in accordance with the received configuration 122 information.

In an embodiment, SNS 102 may store the configuration 122 information for the speakers 106, and when the device 103 is powered on, may push or make available the configuration 122 information to the various detected speakers 106. If SNS 102 detects fewer or additional speakers 106, then SNS 102 may automatically request new configuration 122 information from audio configurator 118. The configuration 122 and speaker setup information 108 may be stored in volatile or non-volatile memory or may be uploaded to a cloud computing system for later access.

As changes are detected to the audio environment (e.g., new speakers 106 are connected, capabilities 112 are changed, existing speakers 106 are disconnected, powered off, encounter errors or failures, or otherwise stop working, or speakers are moved or rearranged relative to each other or a listening area 124, and/or new environment selections 120 are made) audio configurator 118 may automatically update the configuration 122 information for one or more of the connected speakers 106. In an embodiment, the SNS 102 may immediately push or make available the configuration 122 information to the affected speakers 106 each time the system is powered on and/or updated (e.g., when speakers 106 are added, removed, updated, moved, etc.).

Figure 2:
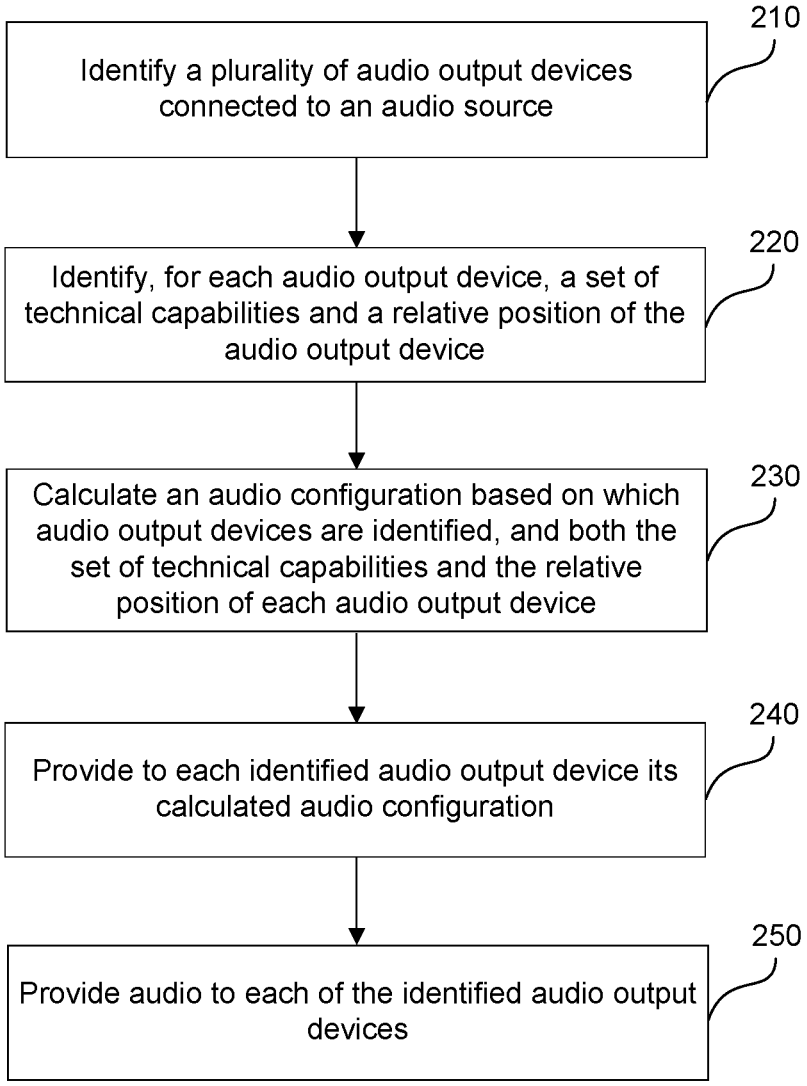
FIG. 2 is a flowchart illustrating example operations for providing a speaker normalization system (SNS), according to some embodiments.

FIG. 2 is a flowchart 200 illustrating example operations for providing a speaker normalization system (SNS) 102, according to some embodiments. Method 200 can be performed by processing logic that can comprise hardware (e.g., circuitry, dedicated logic, programmable logic, microcode, etc.), software (e.g., instructions executing on a processing device), or a combination thereof. It is to be appreciated that not all steps may be needed to perform the disclosure provided herein. Further, some of the steps may be performed simultaneously, or in a different order than shown in FIG. 2, as will be understood by a person of ordinary skill in the art. Method 200 shall be described with reference to FIG. 1. However, method 200 is not limited to the example embodiments.

In 210, a plurality of audio output devices connected to an audio source are identified. For example, SNS 102 may be wired and/or wirelessly connected speakers 106A-106F. Device 103 may be a mobile phone, a gaming system, DVD player, a streaming media player or other audio device which receives audio data 104 over a local, wired, wireless, or Internet connection.

In 220, a set of technical capabilities and a relative position of the audio output device are identified for each audio output device. For example, SNS 102 may request or receive capabilities 112 from the various speakers 106 when connected to device 103, as part of a handshaking protocol. In an embodiment, the capabilities of built-in speaker(s) 106A may already be known and stored by SNS 102. In another embodiment, SNS 102 may receive capability information 112 by a user inputting the make, model, or capability information through a visual interface, or may retrieve the capability information 112 over the Internet.

In an embodiment, a user interact with a user interface (that is displayed on a television, mobile phone, or other visual display) to assign a position and/or role 114 for the various identified speakers 110. For example, SNS 102 may output an audio tone to a connected speaker 106E, and ask a user to assign a role 114 or position to the speaker 106E from which the tone was heard. In an embodiment, using the visual interface, a user may select or configure a room setup 116 and/or environment selection 120 as well which may display or indicate the relative positions of the speakers 106A-F.

In 230, an audio configuration is calculated based on which audio output devices are identified and both the set of technical capabilities and the relative position of each audio output device. For example, audio configurator 118 may calculate configurations 122 for each identified and connected speaker 106 based on capabilities 112, role 114, room setup 116 (e.g., how many speakers are connected and their relative arrangement or placement within or relative to a listening area 124), and type of sound or environment selection 120 desired by a user.

In 240, the calculated audio configuration is provided to each identified audio output device. For example, SNS 102 may push configurations 122 to each connected speaker 106A-F. Then, for example, speakers 106 may use their relative configuration 122 to output audio data packets received from device 103. In an embodiment, SNS 102 may store the configuration 122 and speaker setup 108 for later retrieval upon a system restart or reboot.

In an embodiment, instead of a central location or device 103 calculating and instructing each speaker what to do, SNS 102 may provide the raw information to each speaker 106. Each speaker 106 may then independently calculate what to do (e.g., in terms of audio output). This may work because each speaker 106 may receive the same information about the system, and each speaker 1-6 works from the same set of rules to calculate adjustments (e.g., which may be provided by SNS 102). In an embodiment, this distributed approach may be used in combination with or in lieu of a central management approach.

In 250, audio is provided to each of the identified audio output devices. For example, device 103 may output data packets of audio 104 to the connected speakers 106A-F, which may account for any calculated time delays. The speakers 106A-F may then substantially simultaneously audibly output the audio 104 in accordance with the received configuration information 122.

Figure 3:
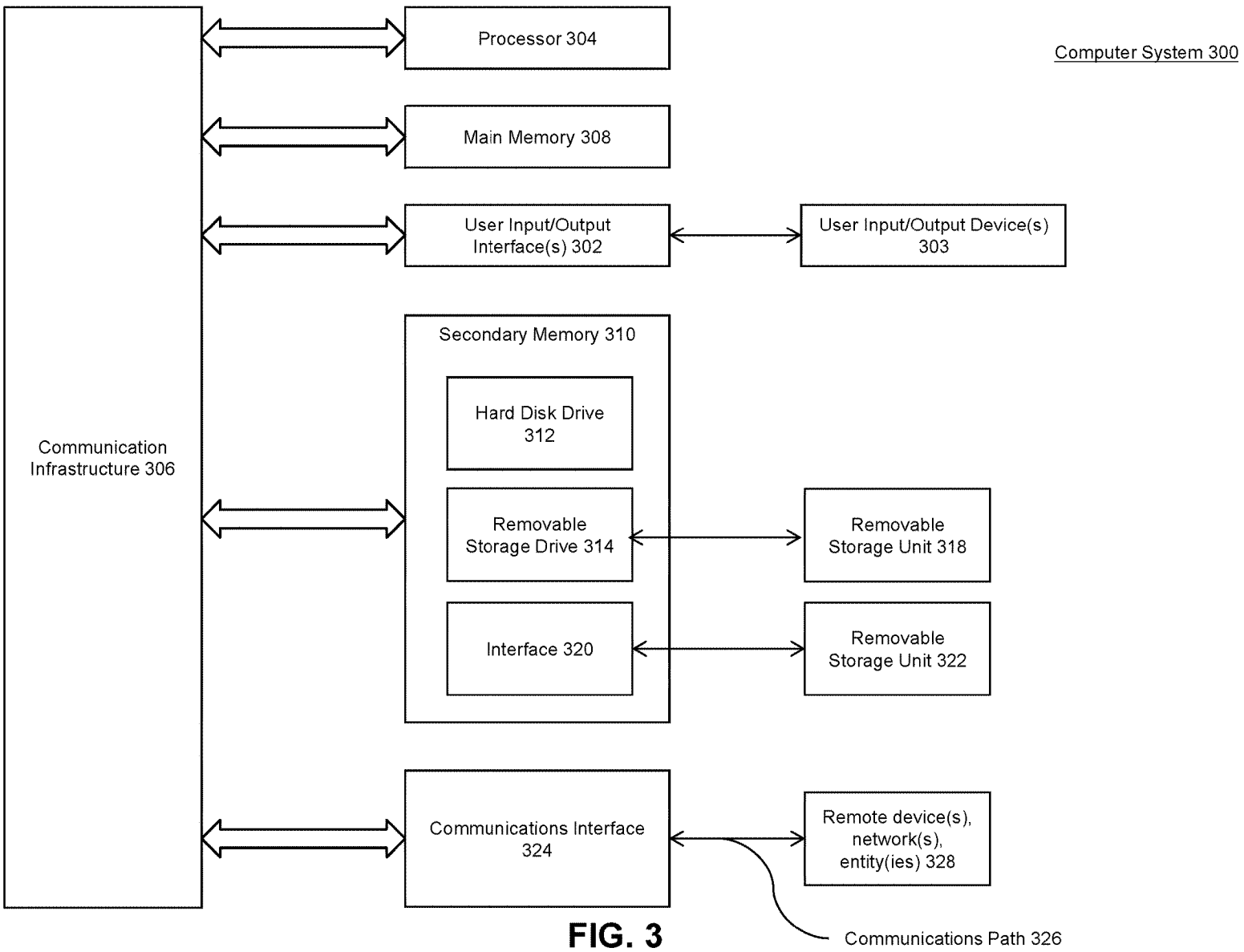
FIG. 3 is example computer system useful for implementing various embodiments.

Various embodiments may be implemented, for example, using one or more well-known computer systems, such as computer system 300 shown in FIG. 3. One or more computer systems 300 may be used, for example, to implement any of the embodiments discussed herein, as well as combinations and sub-combinations thereof.

Computer system 300 may include one or more processors (also called central processing units, or CPUs), such as a processor 304. Processor 304 may be connected to a communication infrastructure or bus 306.

Computer system 300 may also include customer input/output device(s) 303, such as monitors, keyboards, pointing devices, etc., which may communicate with communication infrastructure 306 through customer input/output interface(s) 302.

One or more of processors 304 may be a graphics processing unit (GPU). In an embodiment, a GPU may be a processor that is a specialized electronic circuit designed to process mathematically intensive applications. The GPU may have a parallel structure that is efficient for parallel processing of large blocks of data, such as mathematically intensive data common to computer graphics applications, images, videos, etc.

Computer system 300 may also include a main or primary memory 308, such as random access memory (RAM). Main memory 308 may include one or more levels of cache. Main memory 308 may have stored therein control logic (i.e., computer software) and/or data.

Computer system 300 may also include one or more secondary storage devices or memory 310. Secondary memory 310 may include, for example, a hard disk drive 312 and/or a removable storage device or drive 314. Removable storage drive 314 may be a floppy disk drive, a magnetic tape drive, a compact disk drive, an optical storage device, tape backup device, and/or any other storage device/drive.

Removable storage drive 314 may interact with a removable storage unit 318. Removable storage unit 318 may include a computer usable or readable storage device having stored thereon computer software (control logic) and/or data. Removable storage unit 318 may be a floppy disk, magnetic tape, compact disk, DVD, optical storage disk, and/any other computer data storage device. Removable storage drive 314 may read from and/or write to removable storage unit 318.

Secondary memory 310 may include other means, devices, components, instrumentalities or other approaches for allowing computer programs and/or other instructions and/or data to be accessed by computer system 300. Such means, devices, components, instrumentalities or other approaches may include, for example, a removable storage unit 322 and an interface 320. Examples of the removable storage unit 322 and the interface 320 may include a program cartridge and cartridge interface (such as that found in video game devices), a removable memory chip (such as an EPROM or PROM) and associated socket, a memory stick and USB port, a memory card and associated memory card slot, and/or any other removable storage unit and associated interface.

Computer system 300 may further include a communication or network interface 324. Communication interface 324 may enable computer system 300 to communicate and interact with any combination of external devices, external networks, external entities, etc. (individually and collectively referenced by reference number 328). For example, communication interface 324 may allow computer system 300 to communicate with external or remote devices 328 over communications path 326, which may be wired and/or wireless (or a combination thereof), and which may include any combination of LANs, WANs, the Internet, etc. Control logic and/or data may be transmitted to and from computer system 300 via communication path 326.

Computer system 300 may also be any of a personal digital assistant (PDA), desktop workstation, laptop or notebook computer, netbook, tablet, smart phone, smart watch or other wearable, appliance, part of the Internet-of-Things, and/or embedded system, to name a few non-limiting examples, or any combination thereof.

Computer system 300 may be a client or server, accessing or hosting any applications and/or data through any delivery paradigm, including but not limited to remote or distributed cloud computing solutions; local or on-premises software ("on-premise" cloud-based solutions); "as a service" models (e.g., content as a service (CaaS), digital content as a service (DCaaS), software as a service (SaaS), managed software as a service (MSaaS), platform as a service (PaaS), desktop as a service (DaaS), framework as a service (FaaS), backend as a service (BaaS), mobile backend as a service (MBaaS), infrastructure as a service (IaaS), etc.); and/or a hybrid model including any combination of the foregoing examples or other services or delivery paradigms.

Any applicable data structures, file formats, and schemas in computer system 300 may be derived from standards including but not limited to JavaScript Object Notation (JSON), Extensible Markup Language (XML), Yet Another Markup Language (YAML), Extensible Hypertext Markup Language (XHTML), Wireless Markup Language (WML), MessagePack, XML User Interface Language (XUL), or any other functionally similar representations alone or in combination. Alternatively, proprietary data structures, formats or schemas may be used, either exclusively or in combination with known or open standards.

In some embodiments, a tangible, non-transitory apparatus or article of manufacture comprising a tangible, non-transitory computer useable or readable medium having control logic (software) stored thereon may also be referred to herein as a computer program product or program storage device. This includes, but is not limited to, computer system 300, main memory 308, secondary memory 310, and removable storage units 318 and 322, as well as tangible articles of manufacture embodying any combination of the foregoing. Such control logic, when executed by one or more data processing devices (such as computer system 300), may cause such data processing devices to operate as described herein.

Based on the teachings contained in this disclosure, it will be apparent to persons skilled in the relevant art(s) how to make and use embodiments of this disclosure using data processing devices, computer systems and/or computer architectures other than that shown in FIG. 3. In particular, embodiments can operate with software, hardware, and/or operating system implementations other than those described herein.

It is to be appreciated that the Detailed Description section, and not any other section, is intended to be used to interpret the claims. Other sections can set forth one or more but not all exemplary embodiments as contemplated by the inventor(s), and thus, are not intended to limit this disclosure or the appended claims in any way.

While this disclosure describes exemplary embodiments for exemplary fields and applications, it should be understood that the disclosure is not limited thereto. Other embodiments and modifications thereto are possible, and are within the scope and spirit of this disclosure. For example, and without limiting the generality of this paragraph, embodiments are not limited to the software, hardware, firmware, and/or entities illustrated in the figures and/or described herein. Further, embodiments (whether or not explicitly described herein) have significant utility to fields and applications beyond the examples described herein.

Embodiments have been described herein with the aid of functional building blocks illustrating the implementation of specified functions and relationships thereof. The boundaries of these functional building blocks have been arbitrarily defined herein for the convenience of the description. Alternate boundaries can be defined as long as the specified functions and relationships (or equivalents thereof) are appropriately performed. Also, alternative embodiments can perform functional blocks, steps, operations, methods, etc. using orderings different than those described herein.

References herein to "one embodiment," "an embodiment," "an example embodiment," or similar phrases, indicate that the embodiment described can include a particular feature, structure, or characteristic, but every embodiment can not necessarily include the particular feature, structure, or characteristic. Moreover, such phrases are not necessarily referring to the same embodiment. Further, when a particular feature, structure, or characteristic is described in connection with an embodiment, it would be within the knowledge of persons skilled in the relevant art(s) to incorporate such feature, structure, or characteristic into other embodiments whether or not explicitly mentioned or described herein. Additionally, some embodiments can be described using the expression "coupled" and "connected" along with their derivatives. These terms are not necessarily intended as synonyms for each other. For example, some embodiments can be described using the terms "connected" and/or "coupled" to indicate that two or more elements are in direct physical or electrical contact with each other. The term "coupled," however, can also mean that two or more elements are not in direct contact with each other, but yet still co-operate or interact with each other.

The breadth and scope of this disclosure should not be limited by any of the above-described exemplary embodiments, but should be defined only in accordance with the following claims and their equivalents.

What is claimed is:

1. A method comprising:

identifying a plurality of speakers connected to a soundbar, including its own internal speaker for which capability information is known upon a boot up of the soundbar;

receiving user input indicating a make a model of a first one of the plurality of speakers;

retrieving, over the Internet, capability information for the speaker indicated by the make and model;

receiving from the plurality of speakers, with the exception of the first speaker, a set of technical capabilities of the speaker;

receiving user input indicating a relative position of each speaker, wherein the relative position indicates a height of each speaker;

calculating an audio configuration based on which speakers are identified, and both the set of technical capabilities and the relative position of each speaker;

providing to each identified speaker its calculated audio configuration; and providing audio to each of the identified speaker, wherein the audio is to be simultaneously audibly output by the speakers.

2. The method of claim 1, wherein the speakers include at least one speaker and one subwoofer.

3. The method of claim 2, wherein the technical capabilities include both a frequency and a volume, and wherein the frequency of the subwoofer is lower than the frequency of the at least one speaker.

4. The method of claim 1, wherein the identifying comprises:

detecting that one of the speakers that was identified is no longer connected to the audio source.

5. The method of claim 4, wherein the calculating comprises:

adjusting the audio configuration for at least one of the identified speakers connected to the audio source based on the detecting.

6. The method of claim 1, wherein the technical capabilities include a time delay between the audio source and the speaker as determined by the audio source.

7. The method of claim 1, wherein at least one of the speakers is coupled to the audio source by a wire.

8. The method of claim 1, wherein the soundbar stores the calculated audio configuration for each of the plurality of speakers, and wherein the soundbar pushes the stored calculated audio configuration to each of the plurality of speakers upon a system boot up.

9. A system comprising:

a memory; and least one processor coupled to the memory and configured to perform operations comprising:

identifying a plurality of speakers connected to a soundbar, including its own internal speaker for which capability information is known upon a boot up of the soundbar;

receiving user input indicating a make a model of a first one of the plurality of speakers;

retrieving, over the Internet, capability information for the speaker indicated by the make and model;

receiving from the plurality of speakers, with the exception of the first speaker, a set of technical capabilities of the speaker;

receiving user input indicating a relative position of each speaker, wherein the relative position indicates a height of each speaker;

calculating an audio configuration based on which speakers are identified, and both the set of technical capabilities and the relative position of each speaker;

providing to each identified speaker its calculated audio configuration; and providing audio to each of the identified speaker, wherein the audio is to be simultaneously audibly output by the speakers.

10. The system of claim 9, wherein the speakers include at least one speaker and one subwoofer.

11. The system of claim 10, wherein the technical capabilities include both a frequency and a volume, and wherein the frequency of the subwoofer is lower than the frequency of the at least one speaker.

12. The system of claim 9, wherein the identifying comprises:

detecting that one of the speakers that was identified is no longer connected to the audio source.

13. The system of claim 12, wherein the calculating comprises:

adjusting the audio configuration for at least one of the identified speakers connected to the audio source based on the detecting.

14. The system of claim 9, wherein the technical capabilities include a time delay between the audio source and the speaker as determined by the audio source.

15. A non-transitory computer-readable device having instructions stored thereon that, when executed by at least one computing device, cause the at least one computing device to perform operations comprising:

identifying a plurality of speakers connected to a soundbar, including its own internal speaker for which capability information is known upon a boot up of the soundbar;

receiving user input indicating a make a model of a first one of the plurality of speakers;

retrieving, over the Internet, capability information for the speaker indicated by the make and model;

receiving from the plurality of speakers, with the exception of the first speaker, a set of technical capabilities of the speaker;

receiving user input indicating a relative position of each speaker, wherein the relative position indicates a height of each speaker;

calculating an audio configuration based on which speakers are identified, and both the set of technical capabilities and the relative position of each speaker;

providing to each identified speaker its calculated audio configuration; and providing audio to each of the identified speaker, wherein the audio is to be simultaneously audibly output by the speakers.

16. The device of claim 15, wherein the speakers include at least one speaker and one subwoofer.

17. The device of claim 16, wherein the technical capabilities include both a frequency and a volume, and wherein the frequency of the subwoofer is lower than the frequency of the at least one speaker.

18. The device of claim 15, wherein the identifying comprises:

detecting that one of the speakers that was identified is no longer connected to the audio source.

19. The device of claim 18, wherein the calculating comprises:

adjusting the audio configuration for at least one of the identified speakers connected to the audio source based on the detecting.

20. The device of claim 15, wherein the technical capabilities include a time delay between the audio source and the speaker as determined by the audio source.

* * * * *